US007386270B2

(12) United States Patent
Moteki

(10) Patent No.: US 7,386,270 B2
(45) Date of Patent: Jun. 10, 2008

(54) IMAGE FORMING APPARATUS

(75) Inventor: Junichi Moteki, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 401 days.

(21) Appl. No.: 11/103,058

(22) Filed: Apr. 11, 2005

(65) Prior Publication Data

US 2005/0238399 A1 Oct. 27, 2005

(30) Foreign Application Priority Data

Apr. 26, 2004 (JP) ..... 2004-130379
Feb. 3, 2005 (JP) ..... 2005-027658

(51) Int. Cl.
*G03G 15/00* (2006.01)

(52) U.S. Cl. ..... 399/406; 399/401

(58) Field of Classification Search ..... 399/406, 399/397, 400–402
See application file for complete search history.

(56) References Cited

U.S. PATENT DOCUMENTS 4,627,718 A * 12/1986 Wyer ..... 399/406
4,652,110 A * 3/1987 Sato et al. ..... 399/406
5,572,308 A * 11/1996 Suda et al. ..... 399/401
5,594,542 A * 1/1997 Sugimoto et al. ..... 399/402
5,920,759 A * 7/1999 Ushiroji et al. ..... 399/406
6,618,577 B2 * 9/2003 Omura ..... 399/401
6,980,766 B2 * 12/2005 Ito ..... 399/395
2002/0018680 A1 * 2/2002 Murakami et al. ..... 399/401
2003/0190176 A1 * 10/2003 Tanaka et al. ..... 399/328
2004/0022551 A1 * 2/2004 Ito et al. ..... 399/67

FOREIGN PATENT DOCUMENTS

JP 07172652 * 11/1995
JP 11-199142 A 7/1999

* cited by examiner

*Primary Examiner*—Anthony H. Nguyen
(74) *Attorney, Agent, or Firm*—Canon U.S.A., Inc., IP Division

(57) ABSTRACT

An image forming apparatus comprises a fixing unit for fixing toner image onto a sheet on which the toner image is formed, and a redelivery path for delivering the fixed sheet ejected from the fixing unit to the image forming unit again. A curved path receives the fixed sheet ejected from the fixing unit, reverses the sheet, and delivers the sheet to the redelivery path again. The redelivery path includes a horizontal-registration detection sensor for detecting the edge of the sheet in the width direction and a color density sensor for detecting the color density and color of an image formed on the sheet. A curl-corrector is disposed downstream of the curved path to straighten the curled sheet and then send the sheet to the horizontal-registration detection sensor and the density sensor.

13 Claims, 8 Drawing Sheets

IMAGE FORMING APPARATUS

BACKGROUND OF THE INVENTION

1. Field of the Invention

The present invention relates to an image forming apparatus, such as a copying machine and a printer, and more specifically, relates to an apparatus that has a mechanism to straighten a curled sheet.

2. Description of the Related Art

Some known image forming apparatuses, such as copying machines and printers, are capable of reversing and ejecting a sheet after forming an image on the sheet and/or are capable of forming images on both sides of the sheet. Such image forming apparatuses include a mechanism for reversing and ejecting the sheet and/or a delivering mechanism for reversing the sheet so that an image can be printed on one side of the sheet after an image has been printed on the other side.

Such a known image forming apparatus having such mechanisms comprises an image forming unit including a photoconductive drum, a charging unit disposed in the circumference of the photoreceptor drum, a developing unit, and a transferring unit. When forming an image on a sheet, the sheet is supplied from a paper-supplying unit to the image forming unit, where a toner image is transferred to the sheet. Then the sheet is sent to a fixing unit, where the unfixed toner on the sheet is fixed by heat and pressure. Finally the sheet is ejected from the image forming apparatus.

If an image is also to be formed on the other side of the sheet, the sheet having an image on one side is sent to a reversing path. Subsequently, the sheet is reversed and sent to a reversed-side path so as to deliver the sheet to the image forming unit again. The reversing path is curved and connected to the reversed-side path. The curvature of the reversing path is maximized so as to minimize the width of the image forming apparatus.

In the reversed-side path of such an image forming apparatus, a horizontal-registration detection unit for detecting the alignment of the sheet in the direction orthogonal to the delivery direction of the sheet (hereinafter this direction is referred to as the "width direction" of the sheet) and delivery rollers are provided. To form images on both sides of a sheet, after an image is formed on one side of the sheet, the front edge of the sheet is disposed against the delivery rollers to correct skew. Then the horizontal-registration detection unit detects the edge of the sheet in the width direction. According to the detected results, the position of the image to be formed on the second side of the sheet is adjusted.

An image-detection unit for detecting the color density and color of an image is disposed on an ejection unit of the image forming apparatus for ejecting the sheet on which an image has been formed by the image forming unit. The image-detection unit is provided so as to constantly maintain the color density of the images formed on sheets of paper at an appropriate value. After a reference image having a predetermined color density is formed on a sheet at the image forming unit, the color density of the reference image is detected by the image-detection unit. The measured color density is compared with the desired color density so as to prepare a conversion table. This conversion table is used to control the color density of the image by converting the color density characteristics of the image data in accordance with the conversion table.

However, in the above-described image forming apparatus, when a sheet is delivered through the fixing unit, the sheet curls due to the heat and pressured applied.

As disclosed in Japanese Patent Laid-Open No. 11-199142, to straighten the sheet curled at the fixing unit, a curl-corrector is disposed directly after the fixing unit. The curl-corrector straightens the sheet curled at the fixing unit so that a straightened sheet is delivered to the reversed-side path.

A sheet that has passed through the fixing unit of a known image forming apparatus is heated to a high temperature. Therefore, even if a curl-corrector is provided to straighten the sheet that has passed through the fixing unit, the sheet may curl again when it passes through the curved guide of the reversing path since the sheet may not be sufficiently cooled while it passes through the curved guide of the reversing path.

To efficiently form images on both sides of a sheet and to increase the productivity of the image forming apparatus, a plurality of sheets of paper should repeatedly be circulated through the delivery path of the image forming apparatus and held still at a predetermined time interval so as to minimize the time interval between the formation of an image on each sheet. To repeatedly circulate and hold still a plurality of sheets of paper for image formation, the sheets of paper must be held still at the curved guide of the reversing path. However, the sheet held still at the curved guide of the reversing path curled even more.

When such a curled sheet is delivered through the image forming apparatus, the sheet cannot smoothly enter the nip between the delivery rollers in the reversed-side path. Therefore, the front edge of the sheet cannot be accurately disposed against the delivery rollers to correct skew. Consequently, the detection accuracy of the horizontal-registration detection unit is reduced and sheets of paper easily become jammed in the delivery path.

To avoid such problems, the curvature of the curved guide of the reversing path may be decreased so that the sheets of paper that pass through the guide path curl less. However, reducing the curvature of the curved guide of the reversing path causes an increase in the size of the reversing path and thus causes an increase in the size of the overall image forming apparatus.

The detection accuracy of the image-detection unit may be increased by providing backup rollers that straighten the sheets of paper by pressing against the sheet. However, to provide such backup rollers, the structure of the image forming apparatus becomes complicated and the production cost increases.

SUMMARY OF THE INVENTION

The present invention has taken into consideration the above-described problems and provides an image forming apparatus that has a reduced size and is capable of reliably correcting a curled sheet. The present invention provides an image forming apparatus comprising an image forming unit capable of forming a toner image on a sheet, a fixing unit capable of fixing the toner image onto the sheet on which the toner image is formed by said image forming unit, a redelivery path operable to deliver the fixed sheet ejected from the fixing unit to the image forming unit again, a detection unit operable to detect information on the sheet delivered by the redelivery path, a curved path provided between the fixing unit and the redelivery path and operable to guide the fixed sheet ejected from the fixing unit to the redelivery path after reversing the sheet, and a curl-corrector operable to correct the curling of the sheet. In the image forming apparatus of the present invention, the curl-corrector is operable to correct the curling of the sheet by curving the sheet in the direction opposite to the direction in which the curved path curves, and the detection unit is provided in the redelivery path downstream of the curl-corrector.

Further features and advantages of the present invention will become apparent from the following description of exemplary embodiments with reference to the attached drawings.

DESCRIPTION OF THE EMBODIMENTS

Exemplary embodiments of the present invention will now be described with reference to the drawings. The sizes, materials, shapes, and relative positions of the components included in the embodiment below can be changed in accordance with the structure of the apparatus in which the present invention is to be employed and various other conditions, and these factors do not limit the scope of the present invention.

Figure 1:
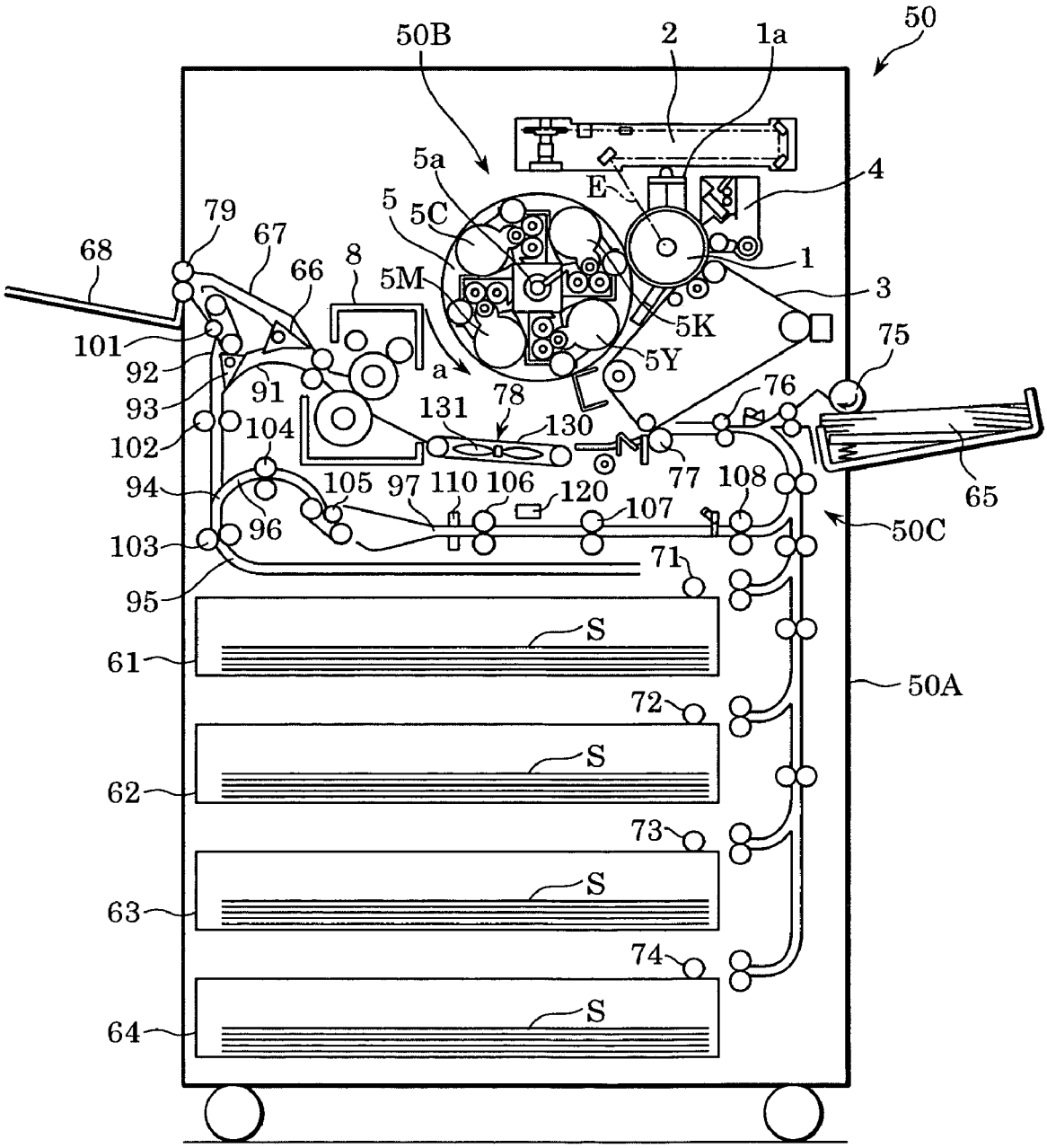
FIG. 1 is a schematic cross-sectional view of the image forming apparatus.

FIG. 1 illustrates the structure of an image forming apparatus according to the present invention. FIG. 1 illustrates a color image forming apparatus 50 comprising a color image forming apparatus body 50A. The color image forming apparatus body 50A comprises an image forming unit 50B and a sheet supplying unit 50C for supplying sheets of paper S.

The image forming unit 50B comprises a photoconductive drum 1, which is an image forming body. The image forming unit 50B further comprises a corona charger 1*a*, a laser exposure optical system 2, an intermediate transfer body 3, a cleaning unit 4, and a rotary developing body 5, all disposed in the periphery of the photoconductive drum 1.

The rotary developing body 5 comprises four developing units: black developing unit 5K, yellow developing unit 5Y, magenta developing unit M5, and cyan developing unit 5C. The rotary developing body 5 is rotatable around a rotary shaft 5*a* in the counterclockwise direction, as indicated by an arrow "a" in the drawings, to move one of the developing units 5Y, 5M, 5C, and 5K to a position opposing the photoconductive drum 1 when required.

The laser exposure optical system 2 converts an image signal sent from a reader (not shown in the drawings) into an optical signal at a laser output unit. The laser beam converted into an optical signal is reflected at a polygon mirror and is projected onto the surface of the photoconductive drum 1 via a lens and various mirrors.

To form an image with the color image forming apparatus 50 having the above-described structure, first, the photoconductive drum 1 is rotated and is uniformly charged by the corona charger 1*a*. Then, a first color light image E is projected onto the photoconductive drum 1 by the laser exposure optical system 2 to form a first color latent image. The latent image on the photoconductive drum 1 is developed by the developing unit for the first color and a toner image of the first color comprising resin and colorant is formed on the photoconductive drum 1. Subsequently, the toner image of the first color formed on the photoconductive drum 1 is transferred onto the intermediate transfer body 3 by a primary transfer process.

After the first color image is developed, the rotary developing body 5 is rotated by 90° in the direction indicated by the arrow "a" so that the development unit for the second color opposes the photoconductive drum 1. After the photoconductive drum 1 completes the primary transfer process and is cleaned by the cleaning unit 4, primary transfer processes of the latent images of the second, third, and fourth colors are completed in the same manner as the first color so that the toner image of each color overlaps on the intermediate transfer body 3. Finally, a full-color toner image is formed on the intermediate transfer body 3. Toner is supplied from toner storage units corresponding to developing units at a predetermined timing so that the proportion (or volume) of toner is maintained at a predetermined level.

The sheets of paper S are supplied one sheet at a time from sheet storage units 61 to 65 by sheet supplying units 71 to 75. After skew is corrected by registration rollers 76, one of the sheets S is sent to a secondary transfer unit 77 at a predetermined timing. At the secondary transfer unit 77, the toner image on the intermediate transfer body 3 is transferred onto the sheet S. Subsequently, the sheet S is sent to a fixing unit 8 by a delivery belt 130 while a suction fan 131 provided at a delivery unit 78 sucks the sheet S onto the delivery belt 130. At the fixing unit 8, the toner image is fixed by heat and pressure. The suction side of the suction fan 131 faces upwards (i.e., faces the side of the delivery belt 130 on which the sheet S is delivered) and the exhaust side of the suction fan 131 faces downwards.

Figure 2:
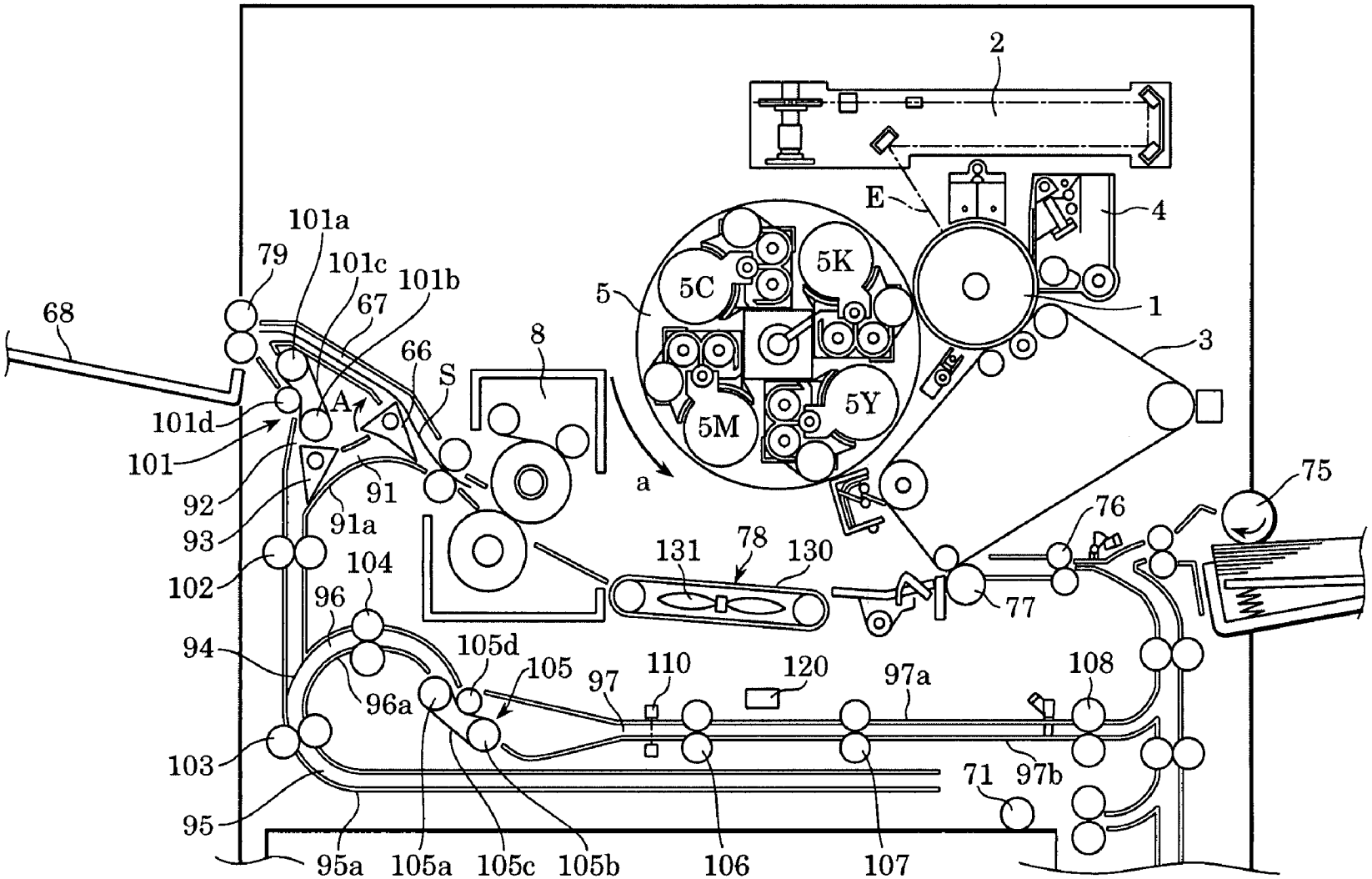
FIG. 2 is a cross-sectional view of main parts of the image forming apparatus illustrating a sheet having an image formed on its upper side being ejected from the apparatus.

When the sheet S, having a toner image fixed on its surface, is ejected from the image forming apparatus body 50A with the image facing upwards, a delivery path-switching guide 66 is moved in the direction indicated by an arrow "A" in FIG. 2 at a predetermined timing after the front edge of the sheet S passes through the fixing unit 8. In this way, the sheet S is guided to an ejection path 67, and then is ejected by an ejection roller 79 to a sheet loading tray 68 provided on the outside of the image forming apparatus body 50A or to a sheet post-processing device not shown in the drawings.

Figure 3:
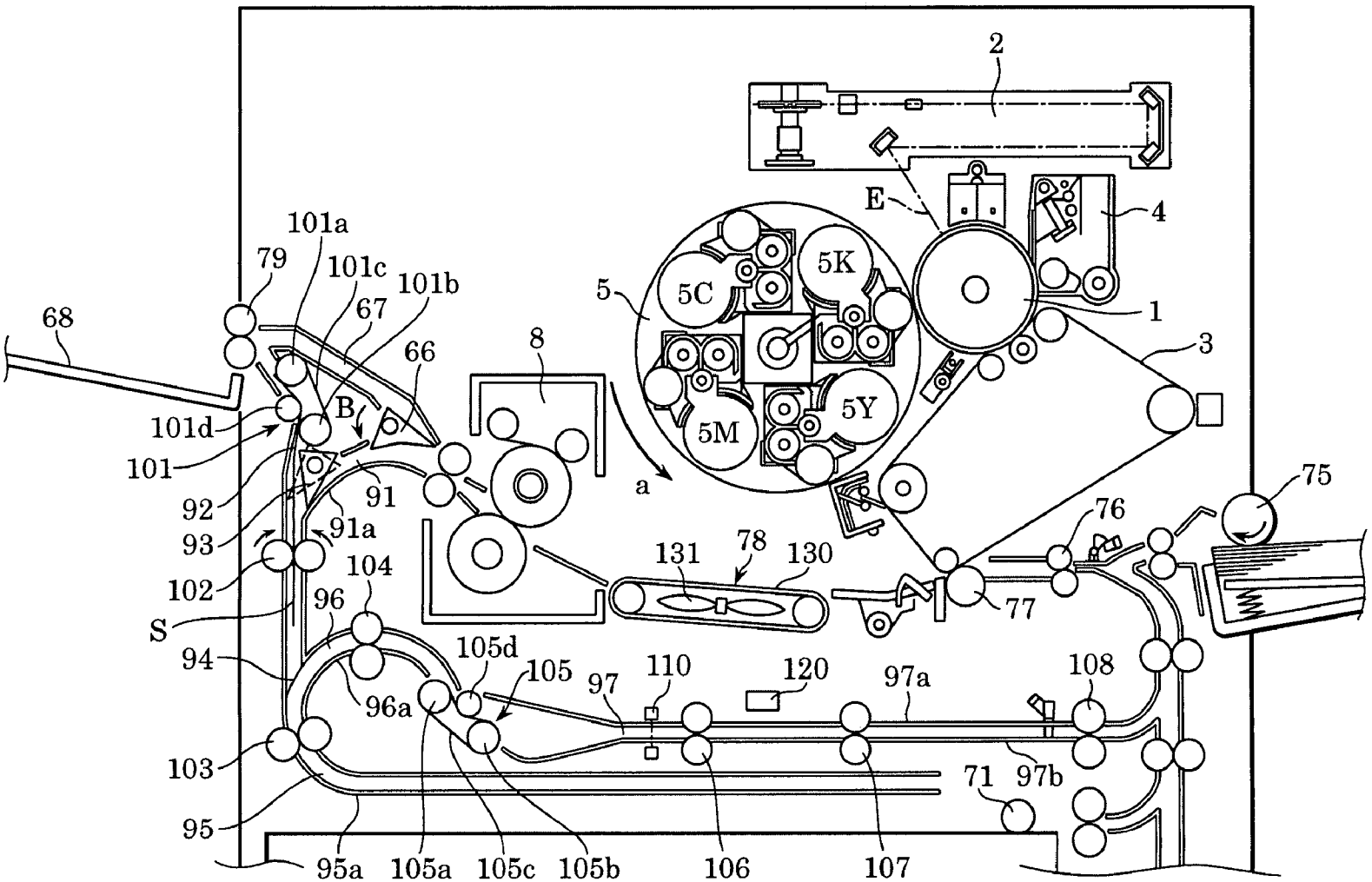
FIG. 3 is a cross-sectional view of main parts of the image forming apparatus illustrating a sheet having an image formed on its lower side being ejected from the apparatus.

When the sheet S having a toner image fixed on its surface is ejected from the image forming apparatus body 50A with the image facing downwards, the delivery path-switching guide 66 is moved in the direction indicated by an arrow B in FIG. 3 at a predetermined timing after the front edge of the sheet S passes through the fixing unit 8. In this way, the sheet S is guided to a reversing path 91. After the rear edge of the sheet S passes through a guide flapper 93, the rotational direction of upper reversing rollers 102, which have been rotating in the direction indicated by the arrows, is reversed. Consequently, the sheet S is sent into a reversed-ejection path 92 from the rear edge, which is the edge opposite to the edge that first entered the upper reversing rollers 102. Finally, the sheet S is ejected to the sheet loading tray 68 provided on the outside of the image forming apparatus body 50A or to a sheet post-processing device not shown in the drawings.

After the sheet S passes through after passing through the fixing unit 8, the sheet S passes through the reversing path 91, which includes a curved guide 91*a*, as illustrated in FIG. 3. When the sheet S heated by the fixing unit 8 passes through the reversing path 91, the sheet S curls along the curve of the curved guide 91*a*. Accordingly, the sheet S curls downwards while the first side of the sheet S (i.e., the side with the image) is facing upwards. In other words, when the sheet S curls 'downwards,' the sheet S forms a convex curve, whereas, when the sheet S curls 'upwards,' the sheet S forms a concave curve.

According to this embodiment, as illustrated in FIG. 3, a reversed-ejection curl-corrector 101 for correcting the curling of the sheet S is provided at the reversed-ejection path 92. The reversed-ejection curl-corrector 101 straightens the curling of the sheet S caused by the curved guide 91*a* of the reversing path 91 by bending the sheet S in the direction opposite to the curling of the sheet S. Since the sheet S curls downwards with the first side of the sheet S is facing downwards, as described above, the reversed-ejection curl-corrector 101 straightens the sheet S by curling the sheet S upwards while the first side of the sheet S is facing upwards.

According to this embodiment, the reversed-ejection curl-corrector 101 comprises two rollers 101*a* and 101*b*, a belt 101*c* loosely wound around the rollers 101*a* and 101*b*, and a roller 101*d* disposed so as to push the belt 101*c* inwards. Consequently, the sheet S is pushed towards the belt 101*c* by the roller 101*d* while being delivered. In this way, the sheet S curves in the direction opposite to the curling direction of the sheet S and, consequently, the downward curl of the sheet S is straightened as the first side of the sheet S is facing upwards. A reversed-side curl-corrector 105, which is described below, also has a similar structure.

The reversed-ejection curl-corrector 101 is disposed in the vicinity of the exit end of the reversing path 91. By providing the reversed-ejection curl-corrector 101 at such a position, the sheet S that has passed through the fixing unit 8 reaches the reversed-ejection curl-corrector 101 while it is still hot. Thus, the sheet S is sufficiently straightened.

Figure 4:
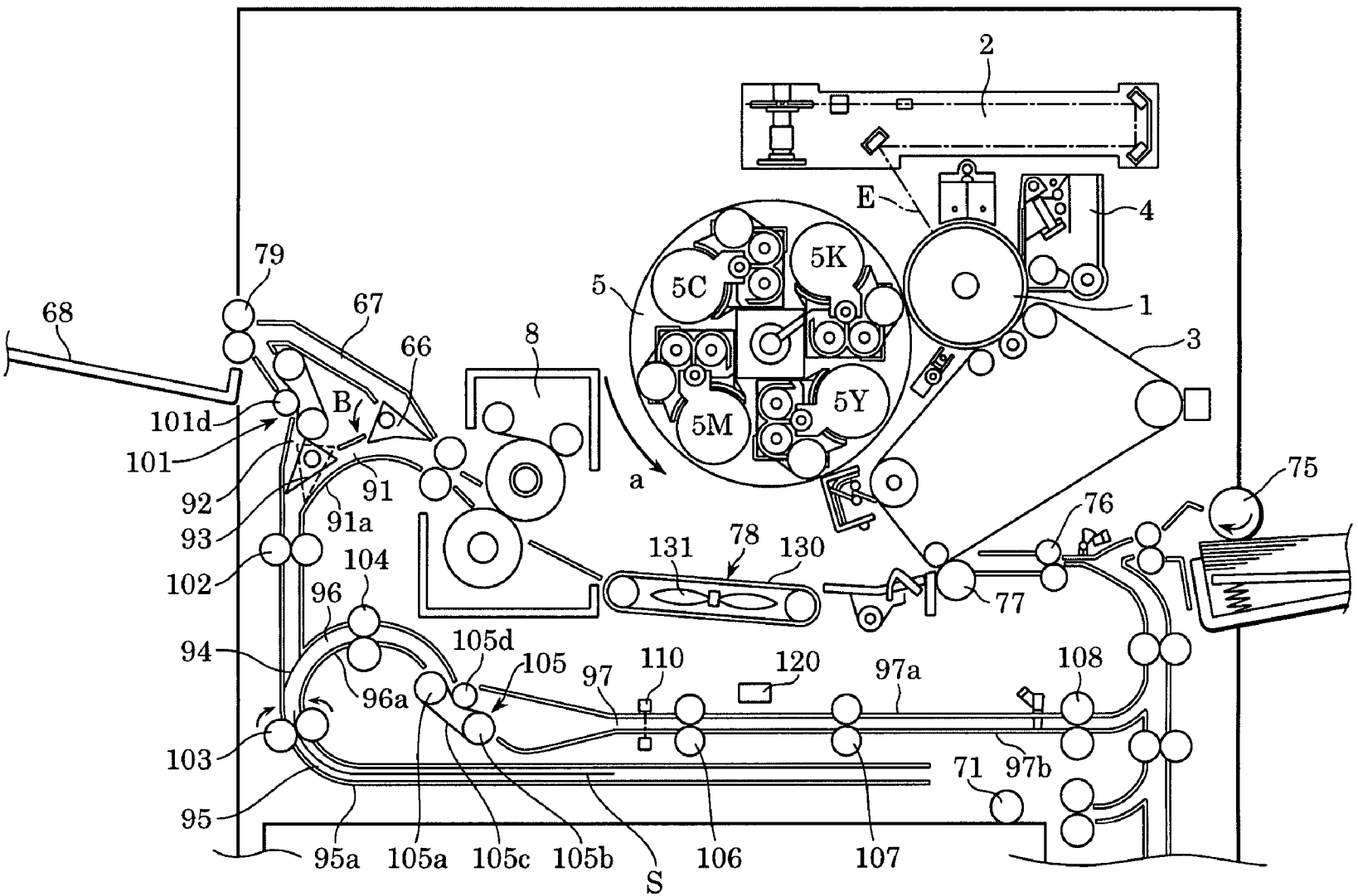
FIG. 4 is a cross-sectional view of main parts of the image forming apparatus illustrating a sheet being guided through the reversed-side delivery path.

To form images on both sides of the sheet S, the sheet S is guided from the reversing path 91 to a reversal-standby path 95 by moving the delivery path-switching guide 66 in the direction indicated by an arrow B illustrated in FIG. 4 at a predetermined timing after the front edge of the sheet S passes through the fixing unit 8. After the rear edge of the sheet S passes through a flexible guide sheet 94, the rotational direction of lower reversing rollers 103, which have been rotating in the direction indicated by the arrows to guide the sheet S downwards, is reversed. Consequently, the rear edge of the sheet S is sent into a reversed-side reversing path 96, which is a curved path. Here, the rear edge is the edge that has first entered the nip between the lower reversing rollers 103.

After the sheet S is sent to the reversed-side reversing path 96, the sheet S is sent to a redelivery path 97. The redelivery path 97 delivers sheets of paper whose images have been fixed at the fixing unit 8 to the image forming unit 50B again. The front edge of the sheet S sent to the redelivery path 97 is disposed against delivery rollers 106 to correct skew.

The redelivery path 97 includes an upper delivery guide 97*a* and a lower delivery guide 97*b*. The redelivery path 97 is disposed linearly and horizontally and is connected to the downstream of the reversed-side reversing path 96.

Figure 5:
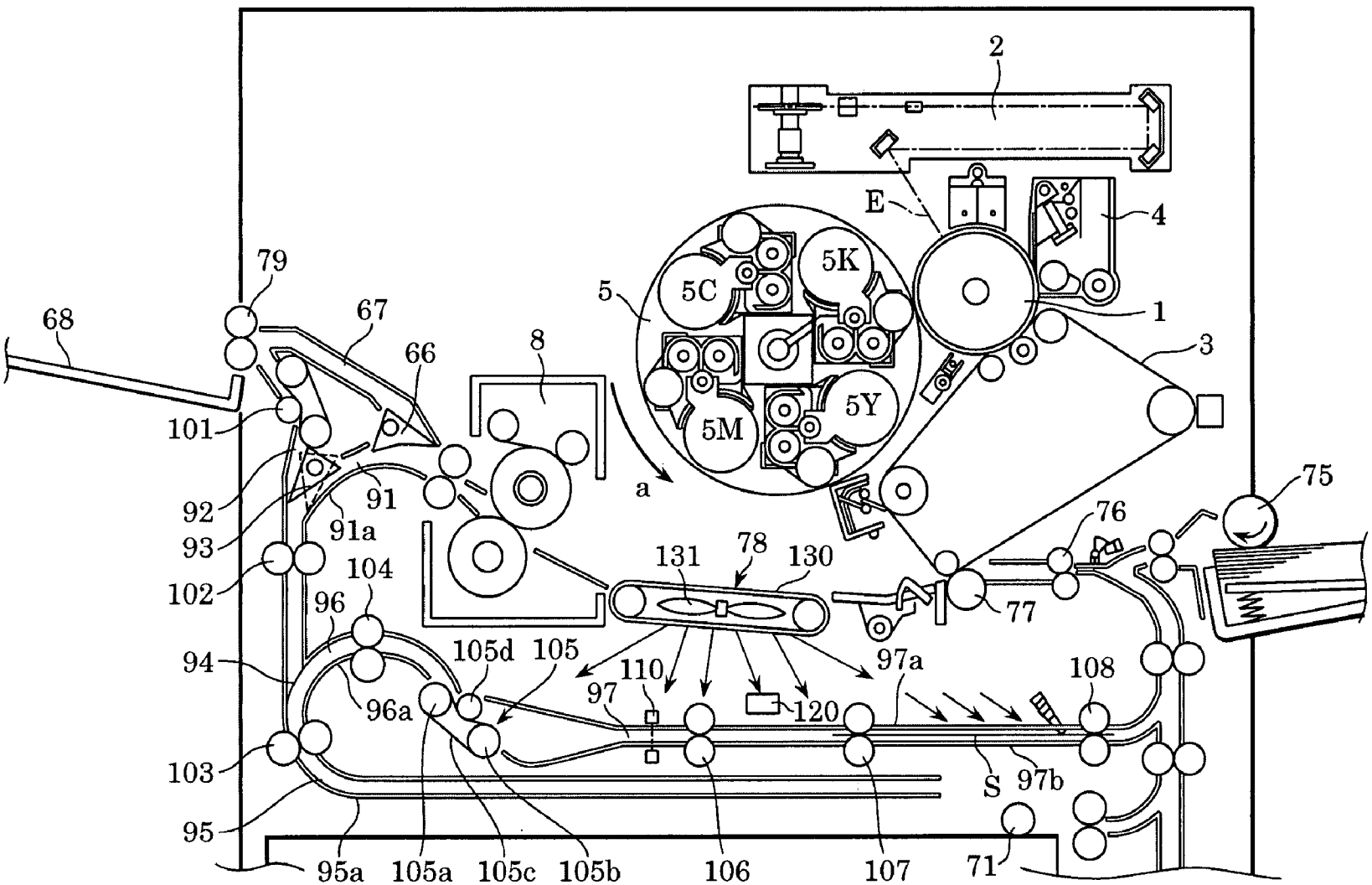
FIG. 5 is a cross-sectional view of main parts of the image forming apparatus illustrating a sheet being cooled in the reversed-side delivery path by a cooling unit.

After skew is corrected by the delivery rollers 106, the sheet S is delivered further by reversed-side delivery rollers 107 and 108. Then, as illustrated in FIG. 5, the sheet S is temporarily held still at the straight portion of the redelivery path 97 by the reversed-side delivery rollers 108 and then is delivered to the registration rollers 76 at a predetermined timing. Subsequently, the sheet S is supplied to the image forming unit 50B via the registration rollers 76 again. The sheet S is passed through the secondary transfer unit 77 and the fixing unit 8 and is finally ejected to the sheet loading tray 68 provided on the outside of the image forming apparatus body 50A or to a sheet post-processing device not shown in the drawings.

FIG. 6 illustrates a horizontal-registration detection sensor 110, disposed on the redelivery path 97, for detecting the position of the sheet S in the width direction. Each of the horizontal-registration detection sensors 110 detects an edged of the sheet S in the width direction after skew of the sheet S is corrected by disposing the front edge of the sheet S against the delivery rollers 106.

As illustrated in FIG. 6, horizontal-registration detection sensor 110 comprises a light-emitting unit (not shown in the drawing) and a light-receiving unit 110*a* for receiving light from the light-emitting unit. The horizontal-registration detection sensor 110 moves in the width direction of the sheet S by a driving unit 112 to detect the edge of the sheet S in the width direction. The edge of the sheet S in the width direction is determined by the position of the sheet S at the moment it blocks light from reaching the light-receiving unit 11*a* or the position of the sheet S at the moment it moves out of the way of the light so that the light reaches the light-receiving unit 110*a*. According to this embodiment, the driving unit 112 comprises a rack 112*a*, a movable plate 112*b*, and a pinion 112*c*. The rack 112*a* is provided on the lower surface of the horizontal-registration detection sensor 110 and the movable plate 112*b* is provided to fix the horizontal-registration detection sensor 110.

Figure 6A:
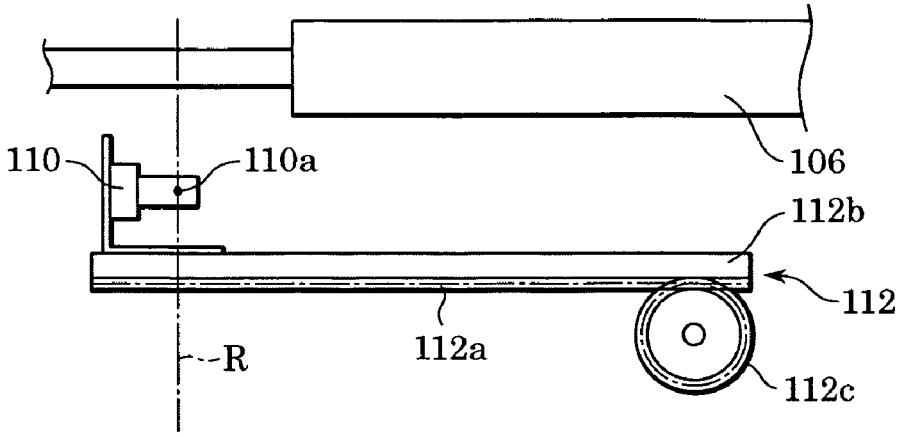
FIG. 6 is a schematic view illustrating the operation of the horizontal-registration detection sensor.

For example, when the sheet S is supplied from the sheet storage unit 61 to form images on both sides of the sheet S, a controlling unit (not shown in the drawings) determines the width of the sheet S on which images are to be formed based on information on the sheet width (sheet size data) set at the sheet storage unit 61. The controlling unit also controls the driving unit 112 so as to move the horizontal-registration detection sensor 110 to a reference position R set in accordance with the position of the edge of the sheet S in the width direction before the front edge of the sheet S reaches the tip of the horizontal-registration detection sensor 110, as illustrated in FIG. 6A. The image forming apparatus according to the present invention sets the centerline of the sheets of paper as the reference line and delivers the sheet based on this central reference line. Therefore, the reference position R differs depending on the size of the sheet.

Subsequently, when the front edge of the sheet S sent to the redelivery path 97 is disposed against the delivery rollers 106 to correct skew, the driving unit 112 moves the horizontal-registration detection sensor 110 in the width direction and detects the position of the edge of the sheet S in the width direction.

Figure 6B:
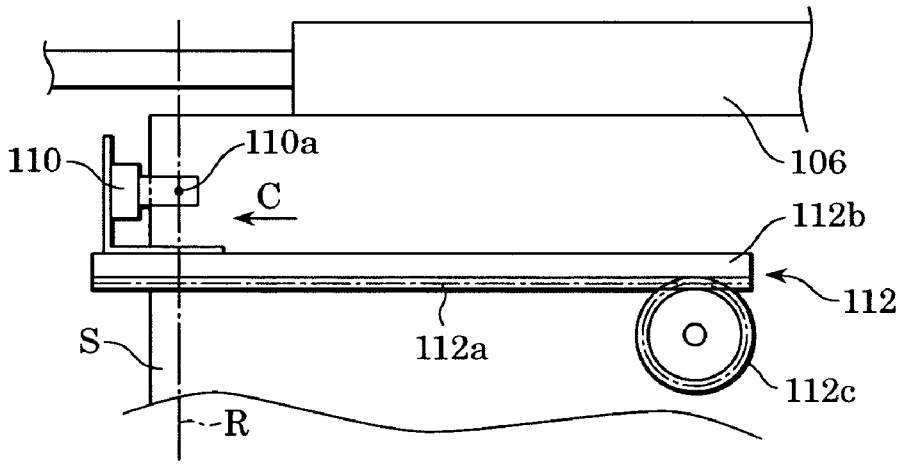

For example, when the sheet S blocks the light emitted from the light-emitting unit, as illustrated in FIG. 6B, the horizontal-registration detection sensor 110 is moved from the reference position R in the direction indicated by an arrow C, and the position of the light-receiving unit 110*a* of the horizontal-registration detection sensor 110 at the moment it moves out of the shade of the sheet S is determined as the edge of the sheet S in the width direction.

Figure 6C:
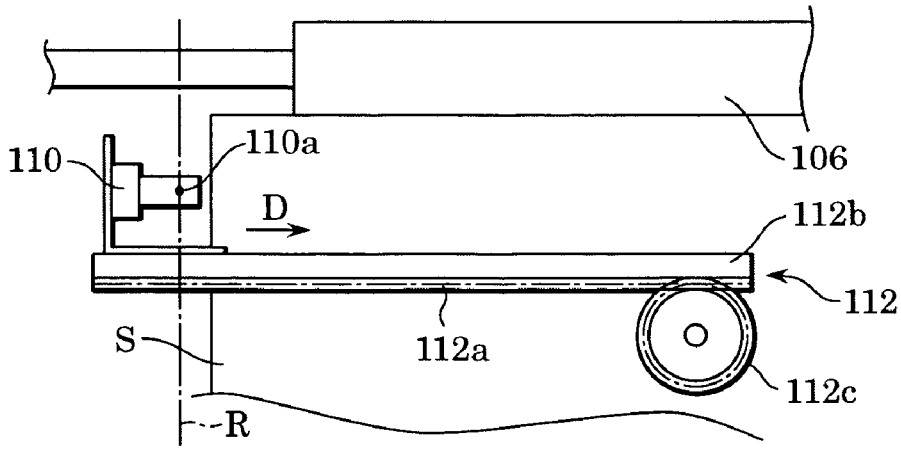

When the sheet S does not block the light emitted to the receiving unit 110*a* of the horizontal-registration detection sensor 110, as illustrated in FIG. 6C, the horizontal-registration detection sensor 110 is moved from the reference position R in the direction indicated by an arrow D, and the position of the light-receiving unit 110*a* of the horizontal-registration detection sensor 110 at the moment it moves into the shade of the sheet S is determined as the edge of the sheet S in the width direction.

After the edge of the sheet S in the width direction is detected in such a manner, the delivery process of the sheet S by the delivery rollers 106 is restored.

The controlling unit corrects the position of the image to be formed on the second side of the sheet S on the photoconductive drum 1 based on the results detected by the horizontal-registration detection sensor 110. Then the toner image is transferred onto the second side of the sheet S in accordance with the image forming process described above. After the toner image is transferred onto the second side of the sheet S and is fixed at the fixing unit 8, the sheet S is ejected to the sheet loading tray 68 provided on the outside of the body of the image forming apparatus or to a sheet post-processing device not shown in the drawings.

According to this embodiment, the edge of the sheet S in the width direction is detected by moving the horizontal-registration detection sensor 110 by the driving unit 112. However, the edge of the sheet S in the width direction may be detected by using a line sensor instead of using the driving unit 112.

A color density sensor 120 for detecting an image quality of an image formed at the image forming unit is provided in the redelivery path 97. For example, the image quality is a color density or color of an image. The color density of the image formed at the image forming unit 50B is adjusted to a normal level based on the results detected by the color density sensor 120.

Figure 7:
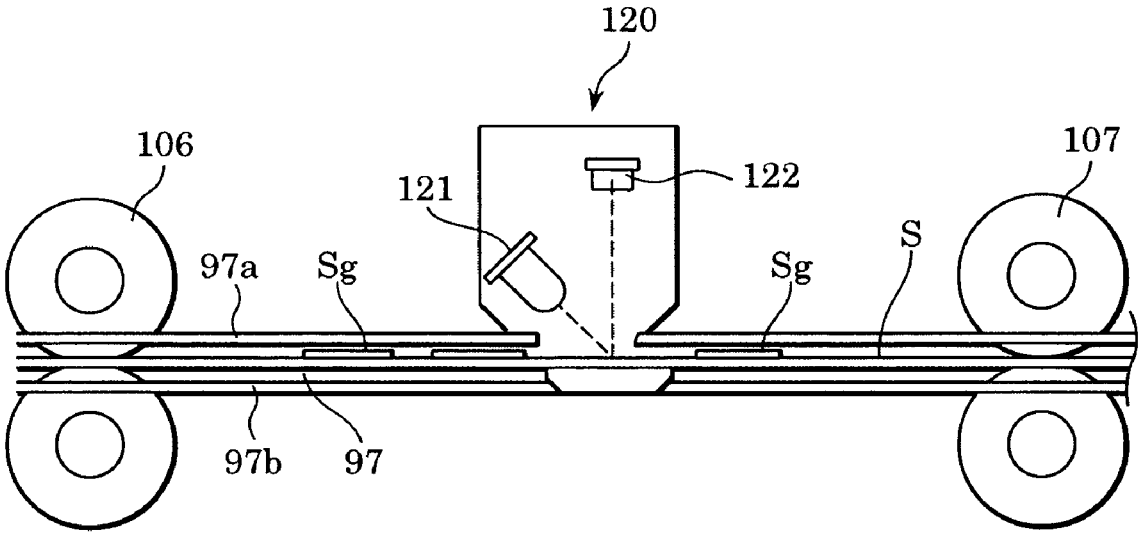
FIG. 7 is a schematic view illustrating the operation of the color density sensor.

Next, a method for adjusting the color density of an image will be described with reference to FIGS. 1 and 7.

A reference image used for adjusting the color density of an image is formed in a similar manner as a regular image wherein the steps of forming a latent image, developing the latent image, carrying out the primary transfer process are repeated. The formation of the image is completed by carrying out the step of secondary transfer in which a toner images is transferred onto the sheet sent to the secondary transfer unit, and the step of fixing the image at the fixing unit 8. The sheet with the reference image is sent through the delivery path-switching guide 66 and the reversing path 91 and is reversed by the lower reversing rollers 103. Then, after the curling of the sheet is straightened at the reversed-side curl-corrector 105, as described below, the sheets are sent to the redelivery path 97.

The image formed is a reference image Sg having a predetermined color density. As illustrated in FIG. 7, a reference light beam is emitted from an irradiation unit 121 disposed inside the color density sensor 120 to a reference image Sg. The reference light beam that is reflected at the reference image Sg is received by a light-receiving unit 122. In accordance with the intensity of the received light beam, a signal is output. Then a conversion table is prepared by comparing the measurement values of the color density obtained from the values of the output signal and the desired values of the color density. The prepared conversion table is used to convert the color density characteristics of the image data and to adjust the color density.

After the reference image Sg on the sheet is read, the sheet is sent through the reversed-side delivery rollers 107 and 108, the registration rollers 76, the image forming unit 50B, the secondary transferring unit 77, and the fixing unit 8 and finally is ejected to the sheet loading tray 68 provided on the outside of the body of the image forming apparatus or to a sheet post-processing device not shown in the drawings.

Since the color density sensor 120 according to this embodiment is provided in the redelivery path 97, the size of the overall image forming apparatus is smaller than a known image forming apparatus having a color density sensor disposed on an ejection unit. Furthermore, since the surface of the light receiving unit 122 of the color density sensor 120 is disposed facing downwards so that the surface is orthogonal to the vertical direction, the surface of the light-receiving unit 122 is less affected by scattered toner and paper powder and enables stable detection.

The image forming apparatus according to this embodiment includes the horizontal-registration detection sensor 110 for detecting the edge of a sheet in the width direction and the color density sensor 120 for detecting the color density and color of an image. However, the image forming apparatus according to the present invention may include an image reader, such as a contact image sensor (CIS) or a charge-coupled device (CCD), disposed in the redelivery path 97 and may simultaneously detect the edge of the sheet in the width direction and the color density and color of the image.

As described above, the sheet S that has passed through the fixing unit 8 curls along the curved guide 91*a* so that the sheet S curls downwards while the first side of the sheet S faces upwards. Moreover, when the sheet S is held still in the curved guide 95*a* of the reversed-side reversal-standby path 95, the sheet S curls downwards even more along the curved guide 95*a* while the first side of the sheet S faces upwards. Subsequently, when the sheet S passes through a curved guide 96*a* of the reversed-side reversing path 96, the sheet S curls downwards even more along the curved guide 96*a* while the first side of the sheet S faces upwards.

Accordingly, as illustrated in FIG. 2, in the image forming apparatus according to this embodiment, the reversed-side curl-corrector 105 for correcting the curling of the sheet S, is disposed in the vicinity of the connection between the reversed-side redelivery path 96 and the redelivery path 97, downstream of the reversed-side redelivery path 96. The reversed-side curl-corrector 105 straightens the sheet S that has been curled by passing through the curved guide 91*a* of the reversing path 91, the curved guide 95*a* of the reversal-standby path 95, and the curved guide 96*a* of the reversed-side reversing path 96.

The reversed-side curl-corrector 105 comprises two rollers 105*a* and 105*b*, a belt 105*c* loosely wound around the rollers 105*a* and 105*b*, and a roller 105*d* disposed so as to push the belt 105*c* inwards. In this way, the sheet S is pushed towards the belt 105*c* by the roller 105*d* while being delivered. In other words, the sheet S curves in the direction opposite to the curling direction of the sheet S.

The connection between the reversed-side reversing path 96 and the redelivery path 97 curves in a direction opposite to the curving direction of the reversed-side reversing path 96. The reversed-side curl-corrector 105 is disposed so that the sheet S is curved in the same direction as the connection.

By disposing the reversed-side curl-corrector 105 downstream of the reversed-side redelivery path 96, the size of the image forming apparatus can be reduced although correcting of the sheet S curled by passing through the fixing unit 8 is carried out efficiently and a straightened sheet is sent into the redelivery path 97.

Moreover, by disposing the reversed-side curl-corrector 105 in the vicinity of the exit end of the reversed-side redelivery path 96, the sheet S heated at the fixing unit 8 reaches the reversed-side curl-corrector 105 before the sheet S is cooled and, thus the sheet S is efficiently straightened.

The reversed-ejection curl-corrector 101 and the reversed-side curl-corrector 105 each comprises of a combination of a belt and rollers. Three rollers may be used to curve the sheet S in the direction opposite to the curling of the sheet S. However, the curl-corrector may have a different structure.

Since the sheet S is sent to the redelivery path 97 after the sheet S is straightened, the sheet S is smoothly sent to the delivery rollers 106. Furthermore, skew is effectively corrected and the detection accuracy of the horizontal-registration detection sensor 110 can be improved. Moreover, since the sheet S is straightened before it passes through the color density sensor 120, vertical fluctuation of the sheet S in the redelivery path 97, which is a typical problem of a scanning sensor, is prevented. Therefore, the detection accuracy of the color density sensor 120 is improved. In this way, the color density of the image forming unit 50B is adjusted stably.

The delivery unit 78 interposed between the image forming unit 50B and the fixing unit 8 is disposed substantially parallel with the upper portion of the redelivery path 97. The exhaust side of the suction fan 131 for sucking the sheet S towards the delivery belt 130 opposes the redelivery path 97. Accordingly, the exhaust air from the suction fan 131 is blown onto the image side of the sheet S in the redelivery path 97 to cool the image side of the sheet S. The sheet S passing through the redelivery path 97 prevents temperature rise of the horizontal-registration detection sensors 110 and the color density sensor 120. The exhaust air from the suction fan 131 is also blown onto the horizontal-registration detection sensors 110 and the color density sensor 120 to directly cool the sensors. The suction fan 131 constitutes the cooling unit according to the present invention.

By cooling the image side of the sheet S at the straight portion of the redelivery path 97, curling of the sheet S caused by contraction of the toner that occurs when the sheet S is cooled is suppressed and the ability to deliver the second side of the sheet S is improved. Furthermore, the sheet S passing through the redelivery path 97 prevents temperature rise of the horizontal-registration detection sensor 110 and the color density sensor 120. Consequently, unstable detection by the sensors due to temperature rise can also be prevented.

Air from the suction fan 131 blowing towards the redelivery path 97 cools, the reversed-side curl-corrector 105, the horizontal-registration detection sensor 110, the color density sensor 120, the reversed-side delivery rollers 107 and 108, the upper delivery guide 97*a*, and the lower delivery guide 97*b*. Air from suction fan 131 entering the redelivery path 97 from the gaps between the delivery guides 97*a* and 97*b* (the gaps at the edge of the sheet S in the width direction and the gaps created by the delivery rollers) cools, the sheet S. The cooling efficiency can be improved by forming a plurality of holes on the upper delivery guide 97*a* and the lower delivery guide 97*b* so that air easily enters these delivery guides.

Next, another structure for cooling the sheet S in the redelivery path 97 is described with reference to FIG. 8. Detailed descriptions are omitted since the components in FIG. 8 indicated by the same reference numerals as FIGS. 1 and 2 are components having the same structures as the components illustrated in FIGS. 1 and 2.

A cooling duct 132 having an opening towards the exhaust side of the suction fan 131 is disposed on the delivery unit 78 interposed between the image forming unit 50B and fixing unit 8. The cooling duct 132 also has an opening towards the redelivery path 97 between the reversed-side delivery rollers 107 and the delivery rollers 108. Air from the suction fan 131 passes through the cooling duct 132 and blows onto the redelivery path 97 between the reversed-side delivery rollers 107 and the reversed-side delivery rollers 108. The suction fan 131 and the cooling duct 132 constitute the cooling unit according to the present invention.

A plurality of holes may be formed on the upper delivery guide 97*a* and the lower delivery guide 97*b* between the reversed-side delivery rollers 107 and 108 so that air from the suction fan 131 can easily enter the redelivery path 97.

Figure 8:
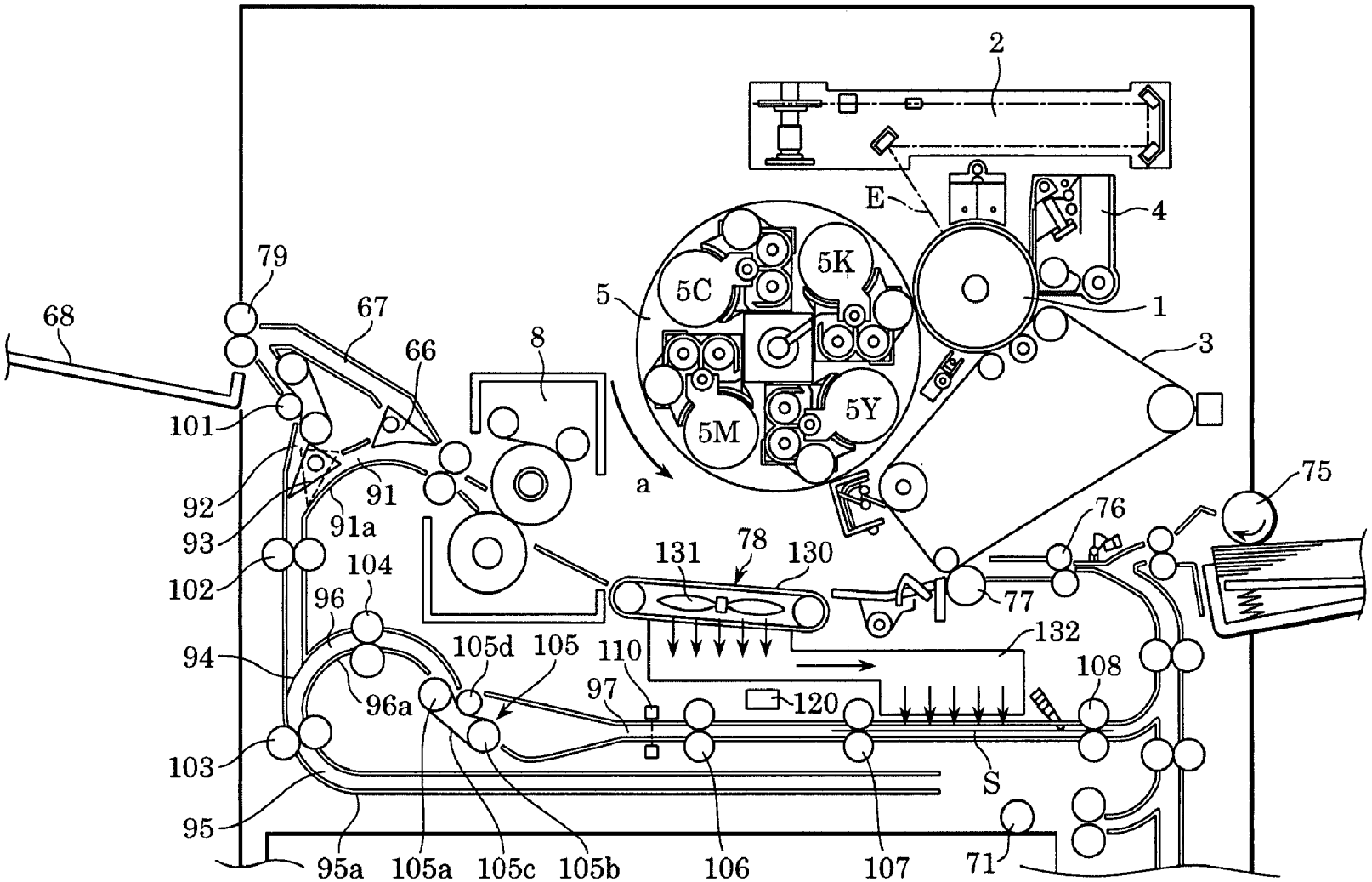
FIG. 8 is a cross-sectional view of main parts of the image forming apparatus illustrating a sheet being cooled in the reversed-side delivery path by another cooling unit.

As illustrated in FIG. 8, the sheet S is temporarily held at the reversed-side delivery rollers 108 in the straight portion of the redelivery path 97 to adjust the delivery timing of the sheet S. At this time, the image side of the sheet S is cooled by air from the suction fan 131 blown on the image side of the sheet S via the cooling duct 132. A predetermined level of tension is applied to the sheet S by the reversed-side delivery rollers 107 and 108 so as to prevent the sheet S from curling due to contraction of the toner that occurs when the sheet S is cooled. In this way, the sheet S is effectively straightened.

Accordingly, by cooling the image side of the sheet S by connecting the straight portion of the redelivery path 97 and the suction fan 131 with the cooling duct 132 and applying tension to the sheet S by the reversed-side delivery rollers 107 and 108, the curling of the sheet S due to contraction of the toner that occurs when the sheet S is cooled is effectively straightened by using the image forming apparatus according to the present invention.

While the present invention has been described with reference to exemplary embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

This application claims priority from Japanese Patent Application No. 2004-130379 filed Apr. 26, 2004 and Japanese Patent Application No. 2005-027658 filed Feb. 3, 2005, which are hereby incorporated by reference herein.

What is claimed is:

1. An image forming apparatus comprising:

an image forming unit capable of forming a toner image on a sheet;

a fixing unit capable of fixing the toner image onto the sheet on which the toner image is formed by said image forming unit;

a redelivery path operable to deliver the fixed sheet ejected from the fixing unit to the image forming unit again;

a detection unit located in the redelivery path and operable to detect information on the sheet delivered by the redelivery path;

a curved path provided between the fixing unit and the redelivery path and operable to guide the fixed sheet ejected from the fixing unit to the redelivery path after reversing the sheet; and a curl-corrector operable to correct curling of the sheet by curving the sheet in the direction opposite to the direction in which the curve path curves.

2. The image forming apparatus according to claim 1, wherein the curl-corrector is located in the vicinity of a connection between the curved path and the redelivery path.

3. The image forming apparatus according to claim 2, wherein the connection between the curved path and the redelivery path curves in the direction opposite to the direction in which the curved path curves, and wherein the curl-corrector is positioned so that the sheet is curved in the same direction as the direction opposite to the direction in which the curved path curves.

4. The image forming apparatus according to claim 1, wherein the detection unit is located in the redelivery path, downstream of the curl-corrector.

5. The image forming apparatus according to claim 1, wherein the detection unit detects an edge of the sheet in a width direction of the sheet and determines the position of the width direction in the redelivery path, the width direction being the direction orthogonal to the delivery direction of the sheet.

6. The image forming apparatus according to claim 1, wherein the detection unit detects a color density or color of the toner image fixed on the sheet at the redelivery path.

7. The image forming apparatus according to claim 1, wherein the redelivery path is a linear structure.

8. The image forming apparatus according to claim 1, further comprising:

a cooling unit operable to cool the image side of the sheet at the redelivery path.

9. The image forming apparatus according to claim 1, further comprising:

a delivery belt operable to deliver the sheet from the image forming unit to the fixing unit;

an air suction unit operable to make the delivery belt to suck the sheet by air; and a cooling unit operable to cool the image side of the sheet at the redelivery path by guiding air exhausted from the air suction unit to the redelivery path.

10. The image forming apparatus according to claim 8, wherein the cooling unit also cools the image side of the sheet at the curl-corrector and the detection unit.

11. The image forming apparatus according to claim 9, wherein the cooling unit also cools the image side of the sheet at the curl-corrector and the detection unit.

12. The image forming apparatus according to claim 8, further comprising a cooling duct operable to send air from the cooling unit to the redelivery path.

13. The image forming apparatus according to claim 9, further comprising a cooling duct operable to send air from the cooling unit to the redelivery path.

* * * * *